United States Patent [19]

Gilbertson

[11] 4,320,799

[45] Mar. 23, 1982

[54] OIL WELL PUMP DRIVING UNIT

[76] Inventor: Thomas A. Gilbertson, 216 Sandringham, N., Moraga, Calif. 94566

[21] Appl. No.: 183,958

[22] Filed: Sep. 3, 1980

[51] Int. Cl.[3] ..... F04B 47/04

[52] U.S. Cl. ..... 166/68.5; 166/84

[58] Field of Search ..... 166/68, 68.5, 72, 84; 91/338, 350; 417/398; 74/590

[56] References Cited

U.S. PATENT DOCUMENTS

| | | | |
|---|---|---|---|
| 1,017,722 | 2/1912 | Wintz | 166/68.5 |
| 1,708,584 | 4/1929 | Mason | 417/398 |
| 1,845,176 | 2/1932 | Palm | 166/75 |
| 2,869,469 | 1/1959 | Williams | 166/68.5 |
| 2,874,641 | 2/1959 | McCandlish et al. | 166/68.5 |
| 3,212,406 | 10/1965 | McDuffie | 166/68.5 |

*Primary Examiner*—James A. Leppink
*Attorney, Agent, or Firm*—Flehr, Hohbach, Test, Albritton & Herbert

[57] ABSTRACT

An oil well pumping apparatus which includes a submerged reciprocating pump mounted in a tubing arrangement communicating with the well head, a sucker rod string extending through the tubing arrangement and connected in driving relation with the pump, and a pumping tee and stuffing box arrangement mounted on the casing of the well at the well head and including a sealed drive rod arrangement in the stuffing box connected in driving relation to said sucker rod string, and a pump driving unit. The pump driving unit includes a hydraulic cylinder and support means for supporting the hydraulic cylinder over the stuffing box with the axis of the cylinder rod aligned with the axis of said stuffing box. A coupling means is provided for coupling the cylinder rod to the seal drive rod arrangement. A hydraulic drive-control unit is coupled to said in-out fluid line for operating the hydraulic cylinder to produce an operating cycle consisting of a hydraulic power upstroke and a gravity power downstroke.

12 Claims, 10 Drawing Figures

OIL WELL PUMP DRIVING UNIT

This invention relates generally to oil well pump driving units and, more specifically, to oil well pump driving units utilizing an hydraulic cylinder to produce a relatively slow pumping stroke.

One of the conventional styles of oil well pump driving units is the walking beam, horsehead unit in which the walking beam and horsehead are driven in a rocking motion. A cable arrangement running over the horsehead is utilized to raise and lower a polished rod which extends through a stuffing box arrangement mounted above the pumping tee on the wellhead casing. The other end of the polished rod is connected to a sucker rod string which extends downhole and is connected on the other end to one of the conventional types of reciprocating pumps.

This conventional type of pump driving unit comes in various sizes to produce various pump stroke lengths depending on the capacity of the well. For smaller wells, units with a stroke length between about twelve and twenty inches per stroke are used. For larger wells, units with a stroke length between 40 and 170 inches per stroke may be used.

Typically, these types of pumping units are run at fairly high stroke rates of anywhere from about 8 to 12 strokes per minute on the smaller units to 12 to 30 strokes per minute on the larger units. The rapid reciprocating motion of the rod string, including the polished rod and the sucker rod string extending down the bore hole, produces certain undesirable operating effects. From a mechanical standpoint, this rapid reciprocation produces acceleration, shock and harmonic loading of the rod string with accompanying high peak rod loads, all of which shorten the life of the rod string. Moreover, it is well known that the rapid pumping stroke of this type of pump driving unit reduces the volumetric pump efficiency due to the rate at which the pump is attempting to move oil up the tubing string and because of the agitation and pounding of the fluid in the well.

An additional problem that can be encountered in pumping light oil, i.e., oil which has a substantial volume of dissolved gas, is gas lock of the pump. Gas lock is generally caused by the gas released from the oil in the formation at a rapid rate as the pressure drops in the pump on the upstroke. If the pressure on the head of liquid in the bore hole is not sufficient to compress the gas released into the pump chamber on the upstroke, pressure of the expanded volume of gas at the top of the pump barrel will not exert sufficient pressure on the traveling valve to counteract the pressure of the fluid column on that valve. Consequently, the valve will not open and no fluid will be moved by the pump. Under this condition, the plunger in the pump merely compresses and expands the gas in the pump barrel. This gas lock problem can make it extremely difficult to pump down some very gaseous wells. Even if a complete gas lock does not occur, the building up of gas in the pump barrel reduces substantially the effective oil pumping capacity due to the volume occupied by the gas.

Very large capacity wells, some in the neighborhood of two hundred barrels per day, justify the use of an expensive cable-type pumping unit, such as the Alpha pump unit manufactured by Bethlehem Steel Corporation, to produce a long, slow pump stroke. The Bethlehem Alpha pumping unit utilizes a pair of spiral cam arrangements mounted on a common shaft, each carrying a cable which is attached either to the sucker rod string through a traveling stuffing box arrangement or to a counterweight arrangement which traverses a counterweight well which must be sunk into the ground near the wellhead. The Bethlehem Alpha rig is an expensive pump driving unit which is cost effective only in large capacity wells, but its typical forty foot stroke and three per minute stroke rate produces a long, slow pump stroke cycle which eliminates the above-mentioned problems inherent in the walking beam pumping unit.

While the Bethlehem Alpha type of pumping unit is available for the larger wells, pump driving units for producing a relatively slow stroke for smaller wells are not currently available on the commercial market. In some areas, the characteristics of certain wells are such that a small walking beam pump unit simply performs so inefficiently in pumping the oil or is subject to intolerable repetitive gas lock conditions that the wells simply are unproductive and remain capped.

In a copending Gilbertson application entitled "Oil Well Pump Driving Unit", Ser. No. 148,380 filed May 9, 1980, an oil well pump driving unit utilizing an hydraulic cylinder to produce a relatively long, slow pumping stroke is disclosed. In this copending application, the hydraulic cylinder is mounted in a horizontal orientation adjacent the wellhead and coupled to the sealed drive rod arrangement in a traveling piston-type stuffing box by way of a cable and sheave arrangement which translates the horizontal motion of the cylinder rod into a vertical motion for driving the rod string of the pumping arrangement. The hydraulic cylinder mounting arrangement and the coupling arrangement between the cylinder rod and the rod string disclosed therein provide an advantageous pumping action for a relatively high capacity wells requiring a stroke length substantially greater than ten feet.

Certain prior art patents disclose oil well pump driving units in which an hydraulic cylinder is utilized to power the rod string driving the reciprocating pump at the bottom of the well. For example, Mason U.S. Pat. No. 1,708,584 and Palm U.S. Pat. No. 1,845,176 disclose oil well pump driving units in which an hydraulic cylinder is mounted directly over a pumping tee and stuffing box arrangement at the wellhead. In the Mason patent a very complicated structural arrangement utilizing a support tower is provided for supporting the hydraulic cylinder. Moreover, a double-acting hydraulic cylinder together with a counterweight arrangement supported on the steel tower structure is utilized in the pump driving unit disclosed in the Mason patent.

The Palm patent discloses a somewhat simpler mounting arrangement for the hydraulic cylinder but also discloses a complex structural arrangement for mounting counterweights which require the use of a double-acting hydraulic cylinder. Moreover, in the Palm patent, the mounting flange of the hydraulic cylinder is apparently formed in an integral fashion with a horizontal support plate carrying two counterweight pulleys with the overall arrangement providing no apparent compensation for any alignment error between the support plate and cylinder and the axis of the stuffing box and pumping tee arrangement. Both the support structure shown in the Mason patent and that disclosed in the Palm patent require a complicated assembly operation for mounting the hydraulic cylinder at the wellhead.

Accordingly, it is an object of this invention to provide an improved oil well pump driving unit utilizing an hydraulic cylinder mounted directly over the pumping tee and stuffing box arrangement at the wellhead.

It is another object of this invention to provide an hydraulic oil well pump driving unit which includes structural components easy to assemble at the wellhead and having provision for self-alignment of the hydraulic cylinder axis with the axis of the pumping tee and stuffing box arrangement at the wellhead.

The pump driving unit of this invention is adapted to be utilized in an oil well pumping apparatus which includes a submerged reciprocating pump mounted in the bottom of a tubing arrangement communicating with the wellhead, a sucker rod string extending through the tubing arrangement and connected in driving relation with the pump, and a pumping tee and stuffing box arrangement mounted on the casing of the well at the wellhead and including a sealed drive rod arrangement in the stuffing box connected in driving relation to the sucker rod string. The pumping tee and stuffing box arrangement may comprise either a stationary stuffing box with sealing glans and polished rod arrangement or an inverted stuffing box arrangement involving a drive rod piston traveling in a polished tube having a length corresponding generally to the maximum length of the pumping stroke.

One aspect of this invention features a pump driving unit which comprises an hydraulic cylinder, including a cylinder rod and an in/out hydraulic fluid line and a support means for supporting the hydraulic cylinder over the stuffing box with the axis of the cylinder rod aligned with the axis of the stuffing box. A coupling means is provided for coupling the cylinder rod to a sealed drive rod arrangement in the stuffing box, and an hydraulic drive/control means is coupled to the in/out fluid line of the cylinder for operating the cylinder to produce an hydraulic power upstroke and a gravity power downstroke. The support means of this invention includes a cylinder support plate and structural means mounting the cylinder support plate above the pumping tee and stuffing box arrangement with the plane of the support plate generally perpendicular to the axis of the stuffing box. A gimbal mounting means is positioned on the cylinder support plate for supporting the cylinder in an axially-floating manner to adjust automatically the orientation of the axis of the cylinder to bring it into alignment with the axis of the stuffing box when the weight of the sucker rod string is applied to the cylinder rod. This automatically compensates for any small errors in the positioning of the cylinder support plate perpendicular to the axis of the stuffing box and the sealed drive rod extending therethrough.

In a preferred embodiment the cylinder support plate includes an aperture which receives the cylinder rod and the gimbal mounting means includes bottom, center, and top gimbal plates supported on the cylinder support plate with the top gimbal plate supporting the mounting flange of the hydraulic cylinder and each of the gimbal plates having an aperture therethrough aligned with the support plate aperture and receiving the cylinder rod. Corresponding pairs of substantially mating faces of the bottom and center gimbal plates and of the top and center gimbal plates each have one of mutually orthogonal arrangements of at least two bearing cups formed therein with bearings received in said bearing cups to permit a small degree of orthogonal rotation of the gimbal plates with respect to each other.

Preferably, the structural means supporting the cylinder support plate comprises a casing choke assembly including a pair of collar plates with complementary semicircular collar surfaces formed therein matching the outside surface of the casing and a clamping arrangement for tightly clamping the collar plates on the well casing such that the plane of the collar plates is generally perpendicular to the axis of the stuffing box mounted in the well casing. At least a pair of support leg arrangements are provided, each including a support leg supported at one end on one of the collar plates with the other end extending above the pumping tee and stuffing box arrangement. The structural means further includes mounting means for mounting the cylinder support plate on the support legs in a plane substantially parallel to the plane of the collar plates.

In a preferred embodiment of this invention, the structural parts for mounting the hydraulic cylinder directly over and in alignment with the axis of a pumping tee and stuffing box arrangement are adapted to be supplied as a kit which is readily assembled in the field at the wellhead. In this preferred embodiment, the collar plates each include a support leg locating aperture formed a precise distance from the semicircular collar surface thereon at a position such that the centerlines of the locating apertures in each of the collar plates lie in a vertical plane passing through the common axis of the semicircular collar surfaces and thus the central axis of the stuffing box when the collar plates are clamped on the casing. The kit further includes a pair of locating pins with associated fastening arrangements adapted to cooperate with the support leg locating apertures in the collar plates to mount the locating pins on the top surface of the collar plate. The locating pins have cylindrical exterior surfaces adapted to permit sections of standard oil well tubing to be closely fit thereover to serve as support legs.

A cylinder support assembly is also provided which is adapted to clamp onto the sections of standard oil well tubing after they are mounted over the locating pins as support legs. This cylinder support assembly includes a cylinder support plate adapted to extend between the tubing sections and having formed on each end a semicircular leg collar surface matching the exterior surface of the support leg tubing section. A pair of leg collar plates having semicircular collar surfaces formed thereon complementary to the semicircular collar surfaces on the cylinder support plate are provided together with a clamping arrangement adapted to tightly clamp the leg collar plates and the cylinder support plates onto the tubing section support legs. The cylinder support plates has an aperture therethrough accurately positioned halfway between the collar surfaces with its centerline in the plane of the axes of the collar surfaces.

A mounting arrangement is also provided which is adapted to mount the hydraulic cylinder on the cylinder support plate with the cylinder rod extending through the aperture in the cylinder support plate and the axis of the cylinder substantially aligned with the axis of the stuffing box. Preferably the cylinder mounting arrangement comprises a gimbal mounting means adapted to be positioned on the cylinder support plate over the central aperture therein for supporting the cylinder in an axially-floating manner to adjust automatically the axis of the cylinder into alignment with the axis of the stuffing box when the weight of the sucker rod string is applied to the cylinder rod. This compensates for any small errors in positioning the cylinder support plate perpendicular to the axis of the stuffing box. This gimbal mounting means is preferably the arrangement comprising bottom, center and top gimbal plates described above.

Oil well pump driving units in accordance with this invention advantageously provide for self-alignment of the axis of the hydraulic cylinder with the axis of the stuffing box arrangement at the wellhead. The casing choke assembly together with the support leg assembly mounted thereon and the cylinder support assembly clamped to the support legs provides generally for a high degree of self-alignment of the respective structural elements utilizing the oil well casing itself as an alignment reference. The gimbal mounting arrangement for supporting the cylinder on the cylinder support plate automatically provides whatever compensation may be required for the axial position of the cylinder to precisely align it with the axis of the stuffing box when the weight of the rod string is coupled to the cylinder rod. The overall structural arrangement of this invention thus eliminates any side loading of the cylinder rod and the corresponding wear on the cylinder which would otherwise be produced by such side loading. Moreover, the structural arrangement of this invention provides for rapid assembly of the oil well pumping apparatus at the wellhead utilizing relatively unskilled labor capable of following simple assembly instructions. The assembly operation is simplified by the straightforward manner in which the various components fit together so that the complete setup of the pump driving unit can be accomplished within a few hours of arrival of the parts at the wellhead.

The pump driving unit of this invention has the advantageous slow pumping stroke which is preferred for pumping efficiency. With a simple interval timer based hydraulic drive/control unit, control over pump stroke length and rate are readily achieved.

Other objects, features and advantages of this invention will be apparent from a consideration of the following detailed description in conjunction with the accompanying drawings.

Figure 1:
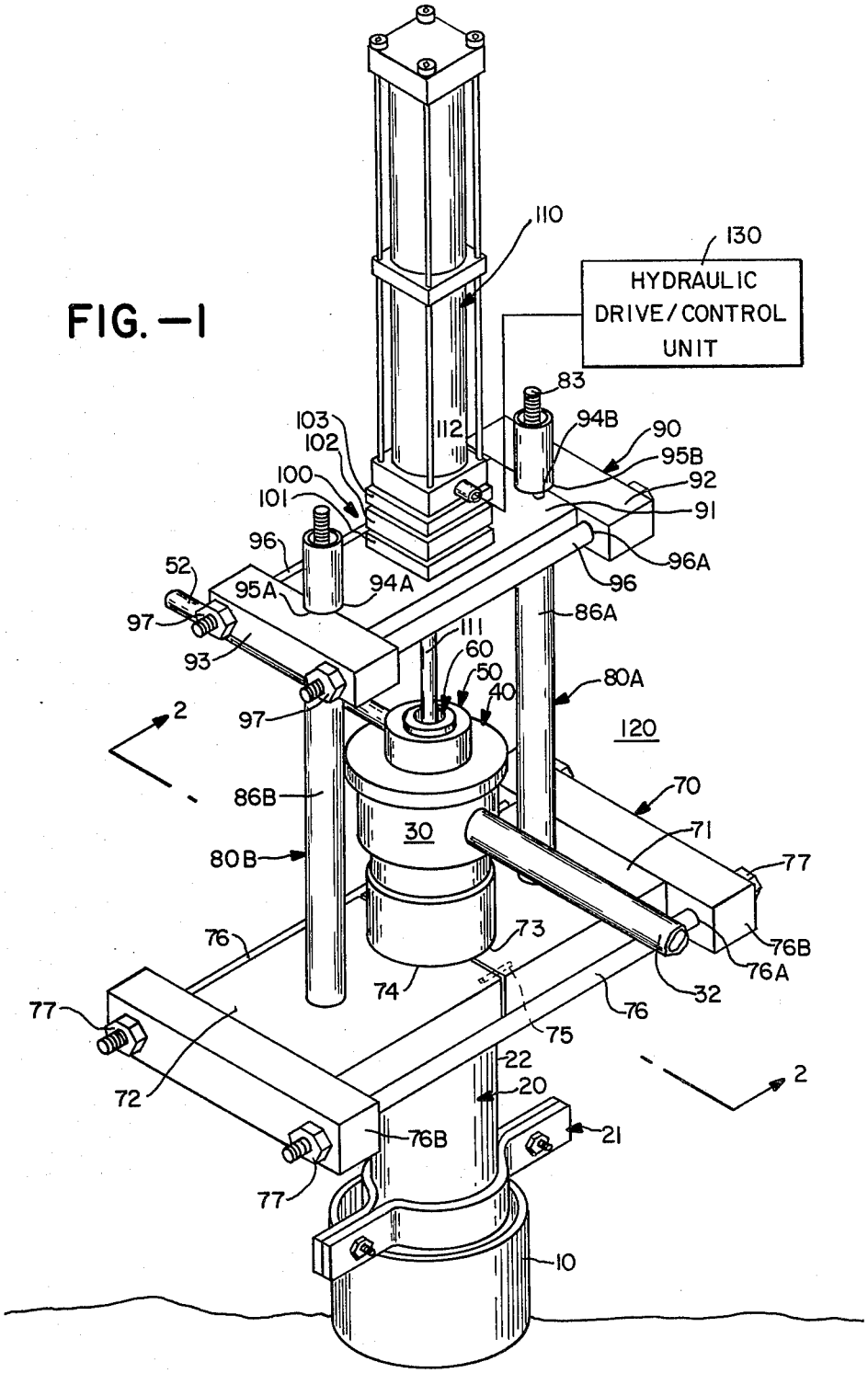
FIG. 1 is an isometric view of an oil well pump driving unit in accordance with this invention.
Figure 2:
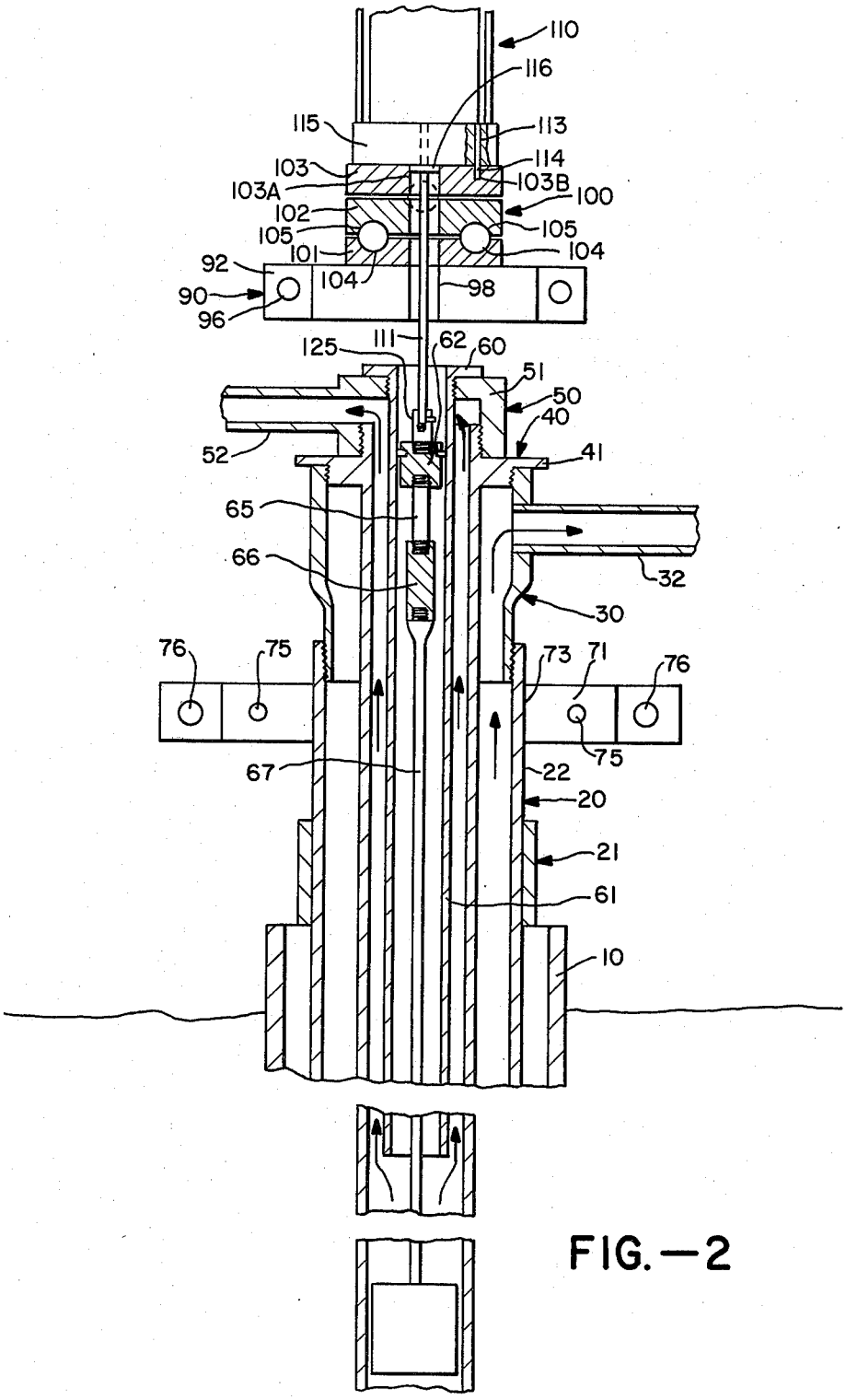
FIG. 2 is a section view of an oil well pump driving unit in accordance with this invention taken along the lines 2—2 in FIG. 1.

FIGS. 1 and 2 illustrate the operating environment for the major components of an oil well pump driving unit in accordance with this invention. As illustrated in FIG. 1, the wellhead of a typical oil well includes a production casing 10 which extends a short distance into the ground and supports a well casing arrangement 20 hung thereon by a casing clamp arrangement 21. In the top opening of casing 20, a gas tee 30 may be provided for exhausting gas from the casing. Mounted on the top of gas tee 30 is a tubing hanger 40 which supports the long tubing string 42 communicating between the top of the wellhead and a conventional reciprocating pump 45 at the bottom of the bore hole. An oil pumping tee 50 is mounted on top of tubing hanger 40 and is in communication with the interior of the tubing string 42 for providing an exit channel 52 for oil pumped out of the bore hole. A stuffing box arrangement 60 is mounted on pumping tee 50 and includes a sealed drive rod arrangement 62 which is coupled via a coupling element 125 to cylinder rod 111 of hydraulic cylinder 110. All of the aforementioned items are relatively standard wellhead equipment with the exception of the inverted stuffing box 60 which is generally of the type utilized on the above-mentioned Bethlehem Alpha rig but is different from the standard polished rod and packing glans arrangement utilized with the conventional horsehead pump driving unit previously described. The travelling piston 62 which serves as a sealed drive rod is connected via a coupling rod 65 and rod box 66 to the sucker rod string 67.

FIGS. 1 and 2 also depict the major components of a pump driving unit in accordance with this invention. These major components include an hydraulic cylinder 110 with a cylinder rod 111 and an in/out hydraulic fluid line 112. A support means 120 is provided for supporting hydraulic cylinder 110 over stuffing box 60 with the axis of cylinder rod 111 aligned with the axis of the stuffing box. A coupling means 125 couples the cylinder rod 111 to a sealed drive rod arrangement 62 (FIG. 2) in stuffing box 60. An hydraulic drive/control unit 160 is coupled to in/out fluid line 112 for operating hydraulic cylinder 110 to produce an operating cycle consisting of an hydraulic power upstroke and a gravity power downstroke. Support arrangement 120 includes a casing choke assembly 70, a pair of support leg assemblies 80A and 80B, a cylinder support assembly 90, and a gimbal mounting arrangement 100. The relative positioning of these various assemblies shown in FIG. 1 is utilized for purposes of illustration so that all of the various components will be visible. FIG. 2 depicts the more likely spatial arrangement between these various assemblies with the cylinder support assembly 90 positioned just slightly above the top of inverted stuffing box 60. In addition, the casing choke assembly 70 is positioned on casing 20 only slightly above casing hanger 21.

Referring now to FIGS. 1 and 2 together, the details of the various structural assemblies may be described. Casing choke assembly 70 includes a pair of collar plates 71 and 72 with complementary semicircular collar surfaces 73 and 74 formed therein. Collar surfaces 73 and 74 match the outside cylindrical surface configuration 22 of casing 20. A pair of threaded rods 76 extending through apertures 76A formed in ear sections 76B of collar plates 71 and 72 together with associated fastening nuts 77 form a clamping arrangement for tightly clamping collar plates 71 and 72 on well casing 20. Collar surfaces 73 and 74 are accurately machined to align the plane of collar plates 71 and 72 substantially perpendicular to the axis of casing 20. A pair of guide pins 75 cooperate with associated apertures in the mating end surfaces of collar plates 71 and 72 to assist in maintaining the collar plates in the same horizontal plane.

Figure 6:
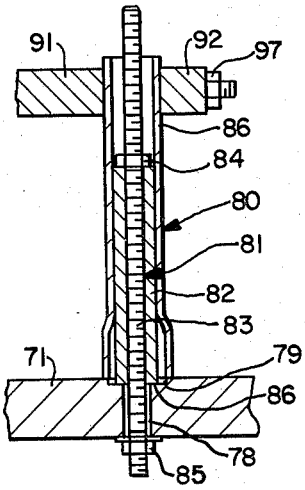
FIG. 6 is a section view of a support leg assembly utilized in an oil well pump driving unit in accordance with this invention.
Figure 7:
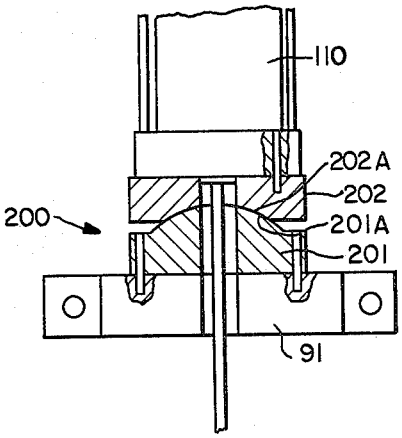
FIG. 7 is a section view of an alternate gimbal mounting arrangement.

FIG. 6 shows a preferred form of support leg assemblies 80A and 80B, generally designated 80 in this figure. As shown in FIG. 6, leg assembly 80 consists essentially of a leg locating pin arrangement 81, including locating pin 82 which preferably has a cylindrical exterior surface, and a support leg tubing section 86 having a hollow wall construction with an inner diameter closely corresponding to the exterior diameter of locating pin 82 so as to closely fit thereover. Locating pin assembly 81 includes locating pin 82 in the form of a hollow tubular pin element, a threaded rod 83 extending through the hollow locating pin 82, a top nut 84 engaging the top surface of locating pin 82 and a bottom fastening nut 85 which serves to fasten locating pin arrangement 81 to collar plate 71. Threaded shaft 83 extends through a support leg locating aperture 78 formed in collar plate 71. Preferably, support leg locating aperture 78 is slightly oversized with respect to the diameter of threaded shaft 83 such that small adjustments in the position of locating pin assembly 81 with respect to support leg locating aperture 78 may be accomplished. Preferably a smooth countersunk bearing surface 79 is provided in the top of collar plate 71 to cooperate with a smooth polished bottom end surface 86 on locating pin 82 to facilitate pin 82 sliding with respect to collar plate 71.

Support leg tubing 86 is preferably a section of standard oil well tubing so that, as will later be discussed, an appropriate length of support leg tubing may be custom cut at the installation site to accommodate the required separation distance between the top of collar plate 71 and the vertical location of cylinder support assembly 90.

Cylinder support assembly 90 consists of a cylinder support plate 91 and a pair of leg collar plates 92 and 93. Cylinder support plate 91 is formed to a length such that it extends between the respective tubing leg sections 86A and 86B. On each end of cylinder support 91 semicircular leg collar surfaces 94A and 94B are formed to match the exterior surface of tubing leg sections 86A and 86B. Correspondingly, leg collar plates 92 and 93 have complementary semicircular collar surfaces 95A and 95B formed therein. Threaded rods 96 which extend through apertures 96A in leg collar plates 91 and 92 form, together with fastening nuts 97, a clamping arrangement for tightly clamping leg collar plates 91 and 92 and cylinder support plate 91 onto the tubing section support legs 86A and 86B. The collar surfaces on the cylinder support plate and the leg collar plates are accurately machined so that as these various plates are clamped together they will generally align in a plane which is perpendicular to the support leg tubing sections 86A and 86B.

Referring back now to the support leg arrangement depicted in FIGS. 1 and 6, the center lines of the locating apertures 78 in each of the collar plates 71 and 72 of the casing choke assembly 70 are positioned such that they lie on a plane which intersects the axis of the collar surfaces 73 and 74 thereon. Accordingly, when collar plates 71 and 72 are clamped around casing 22 with substantially uniform clamping force on both sides of the collar plates, the center lines of support leg locating apertures 78 will lie in the same plane as the axis of stuffing box 60. Any slight misadjustment will be compensated by a slight sliding of locating pin 81 on support plates 71 and 72 as the locating pins 83 are tightened during assembly. Locating pins 82 are formed such that, with the mounting arrangement shown in FIG. 6, they will provide a highly regular vertical alignment of the support leg sections 86. Cylinder support plate 91 is accurately dimensioned such that the collar surfaces 94A and 94B thereon will enable cylinder support plate 91 to be accurately positioned on support legs 86 when clamped thereto by the leg collar plates 92 and 93. The central aperture 98 formed in cylinder support plate 91 is precisely located such that its center line lies in the plane intersecting the center lines of the collar surfaces 94B and 94A and is halfway therebetween. Accordingly, with this accurately controlled mounting arrangement, the centerline of aperture 98 should be very close to alignment with the axis of stuffing box 60 when the assembly is complete.

To compensate for any slight tilt of the plane of cylinder support plate 91 away from being precisely perpendicular to the axis of stuffing box 60, gimbal mounting arrangement 100 is provided on the cylinder support plate 91. Gimbal mounting arrangement 100 includes a bottom gimbal plate 101, a center gimbal plate 102, and a top gimbal plate 103. The mounting flange 115 of cylinder 110 rests on the top surface of top gimbal plate 103 and a cylindrical shoulder 116 on the underside of mounting flange 115 fits accurately into an aperture 103A provided through the center of top gimbal plate 103. A pin 114 extends through mounting flange 115 into a hole 103B in top gimbal plate 103 to restrain cylinder 110 from rotation on top gimbal plate 103.

Figure 3:
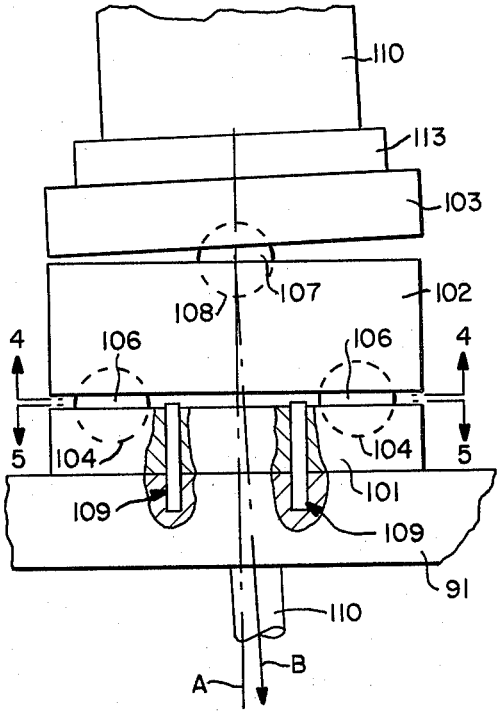
FIG. 3 is an elevational view of a gimbal mounting arrangement utilized in an oil well pump driving unit in accordance with this invention.
Figure 4:
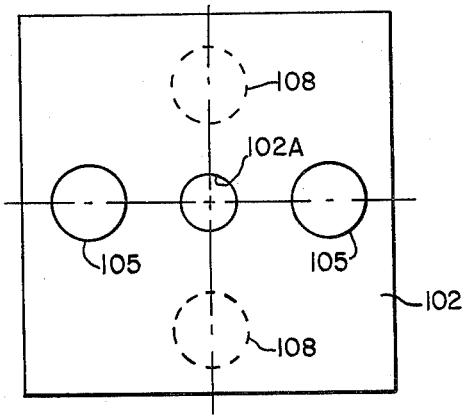
FIG. 4 is a plan view of the center gimbal plate taken along the lines 4—4 in FIG. 3.
Figure 5:
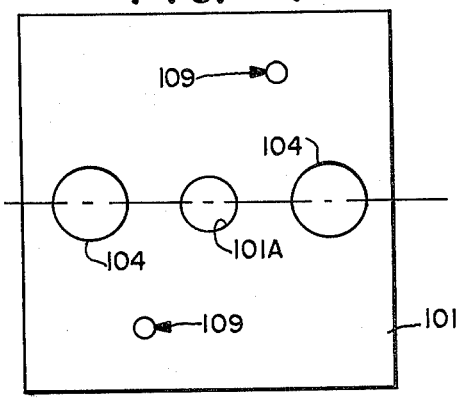
FIG. 5 is a plan view of the bottom gimbal plate taken along the lines 5—5 in FIG. 3.

The overall structure of gimbal mounting arrangement 100 can best be seen by considering FIGS. 1 and 2 together with FIGS. 3, 4, and 5. As shown in FIGS. 2 and 5 bottom gimbal plate 101 has a central aperture 101A therethrough which is aligned with central aperture 98 in cylinder support plate 91. A locating pin arrangement generally designated 109 is utilized to pin bottom gimbal plate 101 in position on cylinder support plate 91. The top surface of bottom gimbal plate 101 has a pair of generally hemispherically shaped cups 104 formed therein. Center gimbal plate 102 also has a central aperture 102A formed therein and the bottom surface of center gimbal plate 105 has a pair of generally hemispherical cups 105 formed therein. The hemispherical cups 104 formed in top surface of bottom gimbal plate 101 are aligned with the center line of aperture 101A and match with the hemispherical cups 105 formed in the bottom surface of center gimbal plate 102. A pair of spherical bearings 106 are received in the respective hemispherical cups such that center gimbal plate 102 is supported on spherical bearings 106 and is free to rotate slightly about the central axis of the two spherical bearings 106.

A corresponding but orthogonal arrangement of hemispherical cups and bearings supports top gimbal plate 103 on center gimbal plate 102 such that top gimbal plate 103 is free to rotate slightly on an axis through spherical bearings 107. In this manner the axial orientation of cylinder 110 and its cylinder rod 111 is substantially floating with respect to the center line of central aperture 98 in cylinder support plate 91. Accordingly, should the plane of cylinder support plate 91 be slightly out of true perpendicular orientation to the axis of stuffing box 60 in FIG. 2, the gimbal mounting arrangement 100 will automatically compensate for slight misalignment when cylinder rod 111 is loaded with the heavy weight of rod string 67 by tilting one or both of the center and top gimbal plates with respect to the bottom gimbal plate 101 as shown in FIG. 3. In FIG. 3 the line A designates a line perpendicular to the plane of cylinder support plate 91 whereas line B designates the axis of tube 61 of stuffing box 60 which determines the direction of pull on cylinder rod 110. As seen in FIG. 3, top gimbal plate 103 has rotated on spherical bearings 107 to bring the axis of cylinder 110 into alignment with the axis line B of stuffing box 60.

It should be understood that the bottom gimbal plate 101 could be eliminated by utilizing the cylinder support plate 91 as the bottom gimbal plate. In such an arrangement the hemispherical cups 104 would be formed directly in the top surface of cylinder support plate 91.

Figure 8:
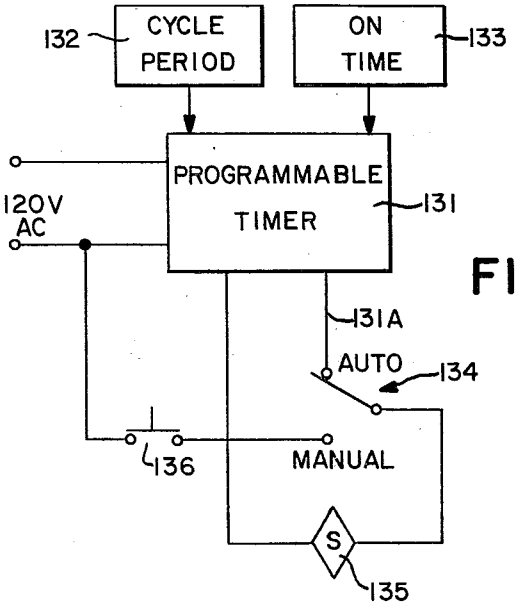
FIG. 8 is a schematic electrical diagram of the electrical portion of a hydraulic drive/control unit in accordance with this invention.

FIG. 8 shows an alternative gimbal support arrangement in which a bottom gimbal plate 201 has a generally spherically shaped top surface 201A formed therein and a top gimbal plate 202 has a complementary spherical cup 202A formed therein. With such a modified gimbal mounting arrangement 200, the same axial floating arrangement for cylinder 110 is achieved since top gimbal plate 202 is free to rotate in any direction with respect to bottom gimbal plate 201.

It should be appreciated that the oil pump driving unit depicted in FIGS. 1 through 5 may be readily manufactured and shipped in kit form for assembly into an overall functioning unit when it arrives at the wellhead. The assembly operation is relatively straightforward and can be accomplished by a pair of individuals having only general mechanical ability. The field assembly of the unit would generally proceed in the following fashion. It is assumed that the well casing 20 has already been put in place, the gas tee 30, tubing hanger 40, oil pumping tee 50, and stuffing box 60 have similarly been installed. The first assembly step is to clamp the casing choke assembly 70 onto the well casing 21. This is readily performed by holding the two collar plates 71 and 72 at the desired vertical position on casing 20 while tightening the nuts 77 onto rods 76 to clamp the collar plates tightly onto the casing. The threaded rods 76 are made of high strength steel so that a very substantial clamping force can be exerted to fasten the collar plates tightly on the well casing.

Once the collar plates are in place, the support leg assemblies 80A and 80B may be mounted to the collar plates. Utilizing the arrangement shown in FIG. 9, the locating pins 82 would be positioned in the countersunk region 79 of collar plates 71 and 72 and the threaded rod 83 inserted through the locating pin 82. The nuts 84 and 85 would be drawn up tight against the top of locating pin 82 and the bottom surface of collar plates 71 and 72. Nut 85 would not be turned very tight at this point in the assembly in order to allow for some adjustment in the positioning of locating pin 82 later if necessary. The next step is to cut to length the necessary sections of support leg tubing 86. Generally, the support tubing sections 86 will be cut slightly longer than the separation distance required from the top of collar plates 71 and 72 to enable the cylinder support assembly 90 to be positioned an inch or two above the top of stuffing box 60. After cutting the support leg tubing sections 86, they are slipped over the locating pins 82 with the bottom edges thereof resting on the top surface of collar plates 71 and 72.

The next step is to clamp the cylinder support assembly 90 onto the support leg tubing sections 86. This is readily done by partially assembling the cylinder support plate 91 together with the leg collar plates 92 and 93 with a small separation distance between the mating end surfaces thereof. An arrangement of locator support pins (not shown) may be provided on the mating end surfaces in order to retain cylinder support plate 91 in horizontal alignment with the leg collar plates 92 and 93 while they are being assembled together. Once the cylinder support assembly 90 is positioned on the support leg tubing sections 86A and 86B, the clamping nuts 97 are tightened to clamp the assembly together such that it is rigidly fastened onto support leg tubing sections 86A and 86B. Only a modest amount of care is required to maintain the cylinder support assembly 90 generally parallel to the casing choke assembly 70 because the gimbal mounting arrangement 100 will compensate for small errors in the mounting of cylinder support assembly 90. Moreover, the cylindrical collar surfaces formed on the various parts of cylinder support assembly 90 tend to produce an automatic alignment of cylinder support plate 91 perpendicular to the axes of the support leg pipe sections 86A and 86B.

The next step is to mount bottom gimbal plate 101 on cylinder support plate 91 using the locating pin arrangement 109 shown in FIG. 3 to retain bottom gimbal plate 101 in position. Thereafter, the spherical bearings 106 are inserted into the bearing cup 104 and center gimbal plate 102 is positioned on bottom gimbal plate 101. Spherical bearings 107 are then placed in bearing cups 108 on center gimbal plate 102 and top gimbal plate 103 is placed in position on the bearings 107.

The structure is now ready for mounting of the hydraulic cylinder on the gimbal mounting arrangement 100. This is accomplished by positioning the hydraulic cylinder 110 over the gimbal mounting arrangement with the cylinder rod 111 extending through the apertures in the various gimbal plates and the central aperture 98 in the cylinder support plate 91. The cylinder is then lowered until the cylindrical shoulder 116 on mounting flange 115 enters the aperture of 103A through top gimbal plate 103. Mounting flange 115 is then pinned to gimbal plate 103 using pin 113. Cylinder rod 111 is then connected to the sealed drive rod in stuffing box 60 by way of coupler 125. As the weight of the rod string is applied to the cylinder rod 111 of hydraulic cylinder 110, the gimbal plates will assume orientations which align the axis of cylinder rod 111 with the axis of stuffing box 60 and with the axis of the piston 62 therein.

The next step is to attach the hydraulic drive/control unit 130 to the cylinder 110, after which the pump driving unit is ready to operate.

It should be understood that there are numerous structural changes which could be made in the support structure 120 for the pump driving unit of this invention and achieve the same overall result. For example, the leg support arrangements 80 could be modified to simply utilize a leg support which is a solid steel bar with a threaded rod formed on one end extending through support leg aperture 78 in the collar plates 71 and 72. In addition, the locating pin and tubular support leg concept could be implemented using a solid cylindrical bar of steel as the locating pin with a threaded shaft formed on one end of the bar to extend through the pin locating aperture 78. It should further be understood that more than two support leg assemblies could be utilized for supporting the cylinder support assembly 90. It should also be understood that, as an alternative to field assembly of the support leg arrangement on collar plates 71 and 72, support legs could be permanently attached by such fastening means as welding to the collar plates 71 and 72 at the place of manufacture. This would necessitate fixturing the support legs with respect to the collar plates so that perpendicular alignment of the two pieces would be achieved. The arrangement disclosed is preferred, however, since it provides for slight adjustments in the positioning of the support legs to insure alignment of the cylinder rod with the axis of the stuffing box in the final assembly of the support structure 120.

The support structure 120 depicted in FIGS. 1 and 2 could also be utilized to support hydraulic cylinder 110 over a stuffing box arrangement which utilizes the standard polished rod and glans arrangement. In this alternative embodiment, the support leg assemblies 80A and 80B would be extended in length to position cylinder 110 a sufficient distance above the stuffing box to accommodate the stroke length of the polished rod. The cylinder rod 111 would be coupled to the polished rod using any suitable type of bridle coupling and this coupling could be essentially the same structure as is employed in coupling a polished rod to the wire rope utilized on a walking beam-horsehead type of pump driving unit. The inverted stuffing box-traveling piston arrangement depicted in FIGS. 1 and 2 is preferred since it enables hydraulic cylinder 110 to be mounted only a short distance above the pumping tee and stuffing box arrangement.

Figure 9:
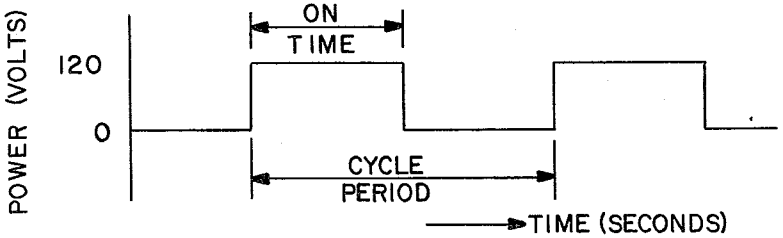
FIG. 9 is an operating cycle diagram for the electrical circuit of FIG. 9.

FIG. 8 shows the electrical circuit of hydraulic drive/control unit 130. A programmable timer 131 which is connected to a source of alternating current provides a program cycle to a valve control solenoid 135 when selector switch 134 is in its automatic position. A cycle period control 132 and an on-time control 133 are utilized to control the program of timer 131. When selector switch 134 is in the manual position a push button switch 136 controls the application of electric power to solenoid 135. As shown in FIG. 9, cycle period control 132 determines the length of the on-off cycle period of programmable timer 131. On-time control 133 determines the proportion of the cycle period during which the AC voltage is applied to output lead 131A leading to the selector switch 134. The function of this timed electrical circuit to control the operating cycle of the hydraulic cylinder 110 can be understood from a consideration of the hydraulic circuit depicted in FIG. 10.

Figure 10:
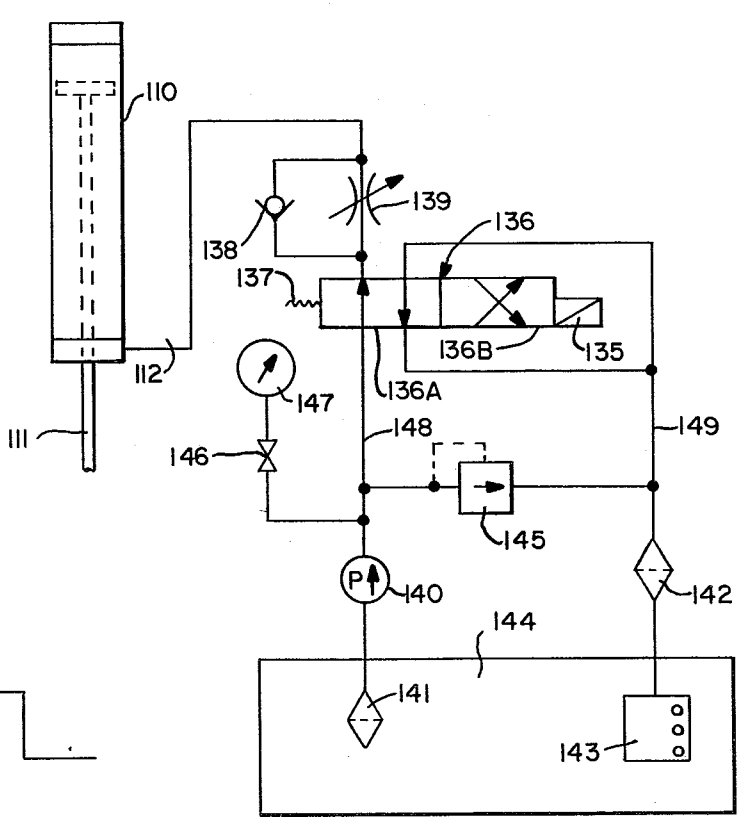
FIG. 10 is a schematic diagram of the hydraulic circuit portion of a hydraulic drive/control unit in accordance with this invention.

As shown in FIG. 10, a hydraulic fluid pump 140 withdraws hydraulic fluid from a reservoir 144 through a strainer 141 and supplies it under pressure to a hydraulic fluid power line 148 which leads to a fluid control valve 136. Fluid control valve 136 has four ports and includes a valve spool which has one position designated 136A in which hydraulic fluid from power line 148 is supplied to the in/out line 112 of hydraulic cylinder 110 through a parallel combination of check valve 138 and a variable restrictor 139. Check valve 138 allows full hydraulic power to be applied to cylinder 110 through the check valve when valve spool 136 is in position 136A. In this position, the hydraulic return line 149 is simply circuited to itself and has no effect on the overall operation. When the valve spool is in the position 136B hydraulic power line 148 is cross-coupled into return line 149, and in/out line 112 is coupled into return line 149. In this position the hydraulic fluid in cylinder 110 flows back into reservoir 144 through variable restrictor 139.

A strainer 142 is provided in the return line to keep the hydraulic oil clean and a diffuser 143 is provided in the hydraulic fluid reservoir 144 to suppress the introduction of air bubbles into the hydraulic fluid. A pilot operated relief valve 145 is coupled between power line 148 and return line 149 as a safety valve to shunt hydraulic fluid between power line 148 and 149 in the event of an unsafe buildup of pressure in power line 148. A pressure gauge 147 connected into power line 148 through a manually operated valve 146 permits metering of the hydraulic fluid pressure in power line 148.

The overall operation of hydraulic drive/control unit 130 is as follows. Programmable timer 131 starts in an off condition as shown in FIG. 9, during which no power is applied to solenoid 135. Accordingly, valve spool 136 is in the position designated 136B. In this position the hydraulic cylinder 110 is in a downstroke cycle and, if not already at the end of this downstroke, the weight of the rod string on cylinder rod 111 will push hydraulic fluid through in/out return line 112 and restrictor 139 into the return line 149.

As programmable timer 131 begins its on-time portion of the cycle period, power is applied to solenoid 135 to pull valve element 136 into position 136A. In this position hydraulic fluid is supplied from power line 148 through check valve 138 into cylinder 110 to start a hydraulic power upstroke. The hydraulic power upstroke lasts until the end of the on-time of programmable timer 131. After the timer goes back to its off condition, solenoid 135 deactuates, and the biasing spring 137 pulls valve element 136 back to position 136B. In this position the hydraulic fluid in cylinder 110 is again returned to reservoir 144 through return line 149 and restrictor valve 139 to produce a downstroke of cylinder rod 110.

It should thus be apparent that restrictor valve 139 can be utilized to control the rate of drop of the cylinder rod 111 and the attached sucker rod string during the gravity power downstroke of cylinder 110. Furthermore, the on-time of programmable timer 131 can be utilized to control the stroke length of cylinder 110 and correspondingly the pumping stroke length. By controlling the setting of the cycle period and on-time controls and manipulating the setting of the restrictor valve 139, any combination of stroke length, stroke position, and stroke rate can be achieved.

While the oil well pump driving unit of this invention has been described above in terms of a preferred embodiment and certain alternative structural aspects which might be employed, it should be understood that numerous other modifications could be made without departing from the scope of the invention as set forth in the following claims.

What is claimed is:

1. In an oil well pumping apparatus which includes a submerged reciprocating pump mounted in a tubing arrangement communicating with the wellhead, a sucker rod string extending through said tubing arrangement and connected in driving relation with said pump, and a pumping tee and stuffing box arrangement mounted on the casing of the well at the wellhead and including a sealed drive rod arrangement in the stuffing box connected in driving relation to said sucker rod string, a pump driving unit comprising:

an hydraulic cylinder, including a cylinder rod and an in/out hydraulic fluid line;

support means for supporting said hydraulic cylinder over said stuffing box with the axis of said cylinder rod aligned with the axis of said stuffing box;

coupling means for coupling said cylinder rod to said sealed drive rod arrangement; and an hydraulic drive/control means coupled to said in/out fluid line for operating said hydraulic cylinder to produce an operating cycle consisting of an hydraulic power upstroke and a gravity power downstroke; said support means including a cylinder support plate, structural means mounting said cylinder support plate above said pumping tee and stuffing box arrangement with the plane of said support plate generally perpendicular to the axis of said stuffing box, and gimbal mounting means positioned on said cylinder support plate for supporting said cylinder in an axially floating manner to adjust automatically the orientation of the axis of said cylinder to bring it into alignment with the axis of said stuffing box when the weight of said sucker rod string is applied to said cylinder rod, thereby to compensate for any small errors in the positioning of said cylinder support plate perpendicular to the axis of said stuffing box.

2. Apparatus as claimed in claim 1, wherein said hydraulic cylinder includes a mounting flange on a bottom end thereof through which passes said cylinder rod; said cylinder support plate includes an aperture receiving said cylinder rod; and said gimbal mounting means includes bottom, center, and top gimbal plates supported on said cylinder support plate with said top gimbal plate supporting said mounting flange of said hydraulic cylinder and each of said gimbal plates having an aperture therethrough aligned with said support plate aperture and receiving said cylinder rod, corresponding pairs of substantially mating faces of said bottom and center gimbal plates and of said top and center gimbal plates each having one of two mutually orthogonal arrangements of at least two bearing cups formed therein with bearings received therein to permit a small degree of orthogonal rotation of said gimbal plates with respect to each other.

3. Apparatus as claimed in claim 1, wherein said structural means comprises:

a casing choke assembly including a pair of collar plates with complementary semicircular collar surfaces formed therein matching the outside surface of said casing and a clamping arrangement for tightly clamping said collar plates on said well casing such that the plane of said collar plates is generally perpendicular to the axis of said stuffing box;

at least a pair of support leg arrangements each including a support leg supported at one end on one of said collar plates with the other end extending above said pumping tee and stuffing box arrangement; and mounting means for mounting said cylinder support plate on said support legs in a plane substantially parallel to the plane of said collar plates.

4. Apparatus as claimed in claim 3, wherein each of said collar plates includes a support leg locating aperture positioned at a location thereon such that the center lines thereof lie in a plane which intersects the central axis of said semicircular collar surfaces;

said support leg arrangements include a support leg locating pin, fastening means including a threaded shaft extending through one of said locating apertures in said collar plates and a nut mounted on said shaft to fasten said locating pin to said collar plate, and a support leg in the form of a hollow cylindrical pipe section fitted tightly over said locating pin;

said cylinder support plate having formed therein on each end a semicircular leg collar surface matching the outside surface of said pipe section and a central aperture for receiving said cylinder rod accurately positioned halfway between said cylindrical leg collar surfaces with its centerline substantially coinciding with a plane passing through the axes of said leg collar surfaces;

and wherein said mounting means for said cylindrical support plate comprises a pair of leg collar plates having semicircular collar surfaces formed on inside surfaces thereof complementary to said leg collar surfaces on said support plate, and a clamping arrangement for tightly clamping said leg collar plates and said support plate on said support leg pipe sections with respective collar surfaces embracing said support leg pipe sections.

5. In an oil well pumping apparatus which includes a submerged, reciprocating pump mounted in a tubing arrangement communicating with the wellhead, a sucker rod string extending through said tubing arrangement and connected in driving relation with said pump, and a pumping tee and stuffing box arrangement mounted on the casing of the well at the wellhead and including a sealed drive rod arrangement in the stuffing box connected in driving relation to said sucker rod string, a pump driving unit comprising:

an hydraulic cylinder, including a cylinder rod and in/out hydraulic fluid line;

coupling means for coupling said cylinder rod to said sealed drive rod arrangement;

an hydraulic drive/control means coupled to said in/out fluid line for operating said hydraulic cylinder; and support means for supporting said hydraulic cylinder directly above said stuffing box with the axis of said cylinder rod aligned with the axis of said stuffing box, said support means comprising:

a casing choke assembly including a pair of collar plates with complementary semicircular collar surfaces formed thereon matching the outside surface of said casing and a clamping arrangement for tightly clamping said collar plates on said well casing such that the plane of said collar plates is generally perpendicular to the axis of said stuffing box;

at least a pair of support leg assemblies each including a support leg and leg mounting means for mounting said support leg to an associated one of said collar plates at a prearranged location with the axes of said support legs perpendicular to the plane of said collar plates and lying in a plane which passes through the axis of said cylindrical collar surfaces on said collar plates;

a cylinder support assembly mounted on said support legs above said pumping tee and stuffing box arrangement and including a cylinder support plate extending between said support legs and having formed on each end thereof a leg collar surface matching the exterior surface configuration of said support leg with an aperture formed through said cylinder support plate and having a centerline location positioned halfway between said leg collar surfaces and lying in a plane passing through the centerlines of said leg collar surfaces, a pair of leg collar plates having leg collars formed thereon complementary to said leg collars on said cylinder support plate, a clamping arrangement for tightly clamping said leg collar plates and said support plate on said support legs with said respective leg collar surfaces embracing said support legs, and a mounting arrangement for mounting said cylinder on said cylinder support plate.

6. Apparatus as claimed in claim 5, wherein said cylinder mounting arrangement comprises a gimbal mounting means for supporting said cylinder on said cylinder support plate in an axially-floating manner to adjust automatically the axis of said cylinder into alignment with the axis of said stuffing box when the weight of the sucker rod string is applied to said cylinder rod thereby to compensate for any small errors in positioning said cylinder support plate perpendicular to the axis of said stuffing box.

7. Apparatus as claimed in claim 5, wherein each of said collar plates in said casing choke assembly includes a support leg locating aperture formed a precise distance from said cylindrical collar surface at a position such that the center lines of said locating apertures lie in a vertical plane passing through the axis of said cylinder collar surfaces and said stuffing box arrangement; and said support leg arrangements each includes a pair of locating pins with associated fastening arrangements cooperating with said support leg locating apertures in said collar plates to mount said locating pins on said collar plates, said support legs comprising hollow tubular sections closely fitting over said locating pins.

8. Apparatus as claimed in claim 6, wherein said gimbal mounting means includes bottom, center, and top gimbal plates supported on said cylinder support plate with said top gimbal plate supporting said mounting flange of said hydraulic cylinder and each of said gimbal plates having an aperture therethrough aligned with said support plate aperture and receiving said cylinder rod, corresponding pairs of substantially mating faces of said bottom and center gimbal plates and of said top and center gimbal plates each having one of mutually orthogonal arrangements of at least two bearing cups formed therein with bearings received therein to permit a small degree of orthogonal rotation of said gimbal plates with respect to each other.

9. Apparatus as claimed in any of claims 1 and 5, wherein said hydraulic drive/control means comprises an hydraulic generator having power and return lines; a fluid control valve coupled to said in/out fluid line, said power line and said return line and including a valve element and a valve element driving arrangement comprising a solenoid actuable to switch said valve element between first and second positions and spring biasing means for biasing said valve element into said first position when said solenoid is deactuated, said first valve element position establishing separate connections between said return line and each of said power line and said in-out line to permit a gravity power downstroke of said cylinder and said second valve element position establishing a connection between said power line and said in-out line to provide an hydraulically powered upstroke for said cylinder; a presettable flow restrictor and a check valve coupled in parallel between said fluid control valve and said in/out line for controlling the rate of fluid transfer out of said cylinder during said downstroke; and control means coupled to said valve driving arrangement for establishing a presettable operating cycle period for said fluid control valve including a presettable first time segment during which said solenoid is actuated to produce said hydraulically powered upstroke.

10. A kit of structural parts for mounting an hydraulic cylinder directly over and in alignment with the axis of a pumping tee and stuffing box arrangement mounted on the casing of an oil well at the wellhead, said kit comprising:

a casing choke assembly including a pair of collar plates with preformed cylindrical collar surfaces matching the outside surface of said casing and a clamping arrangement adapted to clamp said collar plates on said well casing such that the plane of said collar plates is generally perpendicular to the axis of said stuffing box, each of said collar plates including a support leg locating aperture formed a precise distance from said cylindrical collar surface thereon at a position such that the centerlines of said locating apertures in each of said collar plates lie in a vertical plane passing through the common axis of said cylindrical collar surfaces and the axis of said stuffing box when said collar plates are clamped on said casing;

a pair of locating pins with associated fastening arrangements adapted to cooperate with said support leg locating apertures in said collar plates to mount said locating pins on said collar plates, said locating pins each having cylindrical exterior surfaces adapted to permit a section of standard oil well tubing to be closely fit thereover to serve as support legs;

a cylinder support arrangement adapted to clamp onto said sections of standard oil well tubing when mounted over said locating pins as support legs, said cylinder support arrangement including a cylinder support plate adapted to extend between said tubing sections and having formed on each end a semicircular leg collar surface matching the exterior surface of said tubing section, a pair of leg collar plates having semicircular collar surfaces formed thereon complementary to said collar surfaces on said cylinder support plate, and a clamping arrangement adapted to tightly clamp said leg collar plates and said cylinder support plate onto said tubing section support legs, said cylinder support plate having an aperture therethrough accurately positioned halfway between said cylinder collar surfaces with its centerline in the plane of the axes of said cylinder collar surfaces, and a mounting arrangement adapted to mount an hydraulic cylinder on said cylinder support plate with a cylinder rod extending through said aperture in said cylinder support plate and the axis of said cylinder substantially aligned with the axis of said stuffing box.

11. Apparatus as claimed in claim 10, wherein said cylinder mounting arrangement comprises a gimbal mounting means adapted to be positioned on said cylinder support plate over said central aperture therein for supporting said cylinder in an axially-floating manner to adjust automatically the axis of said cylinder into alignment with the axis of said stuffing box when weight is applied to said cylinder rod after coupling it to a sealed drive arrangement in said stuffing box, thereby compensating for any small errors in positioning said cylinder support plate perpendicular to the axis of said stuffing box.

12. Apparatus as claimed in claim 11, wherein said gimbal mounting means comprises bottom, center, and top gimbal plates adapted to be supported on said cyinder support plate with said top gimbal plate adapted to support a mounting flange of an hydraulic cylinder and each of said gimbal plates having an aperture therethrough aligned with said support plate aperture for receiving said cylinder rod, corresponding pairs of substantially mating faces of said bottom and center gimbal plates and of said top and center gimbal plates each having mutually orthogonal arrangements of at least two bearing cups formed therein with bearings received therein to permit a small degree of orthogonal rotation of said gimbal plates with respect to each other.

* * * * *